US008062415B2

(12) United States Patent
Davenport et al.

(10) Patent No.: US 8,062,415 B2
(45) Date of Patent: Nov. 22, 2011

(54) PAPER COATING COMPOSITIONS

(75) Inventors: Ray Davenport, Greensboro, NC (US); Charles Hunger, Ettingen (CH); Ian William Knowles, Stockport (GB); Terry Lloyd, Greensboro, NC (US); Barry McLow, Manchester (GB); Heinz Schneider, Congleton (GB)

(73) Assignee: BASF SE, Ludwigshafen (DE)

( * ) Notice: Subject to any disclaimer, the term of this patent is extended or adjusted under 35 U.S.C. 154(b) by 965 days.

(21) Appl. No.: 10/552,531

(22) PCT Filed: Apr. 5, 2004

(86) PCT No.: PCT/EP2004/050443

§ 371 (c)(1),
(2), (4) Date: Jul. 13, 2006

(87) PCT Pub. No.: WO2004/090228

PCT Pub. Date: Oct. 21, 2004

(65) Prior Publication Data

US 2007/0266894 A1 Nov. 22, 2007

(30) Foreign Application Priority Data

Apr. 14, 2003 (GB) ..... 0308487.8

(51) Int. Cl.

| | |
|---|---|
| ***C09D 109/10*** | (2006.01) |
| ***C09D 103/04*** | (2006.01) |
| ***C09B 67/22*** | (2006.01) |
| ***D21H 19/36*** | (2006.01) |
| ***D21H 19/42*** | (2006.01) |
| ***D21H 21/28*** | (2006.01) |

(52) U.S. Cl. ..... 106/493; 106/410; 106/413; 106/496; 106/497; 106/498; 162/158; 162/161; 162/162; 428/537.5

(58) Field of Classification Search ..... 106/410, 106/413, 493, 496, 497, 498; 162/158, 161, 162/162; 428/537.5
See application file for complete search history.

(56) References Cited

U.S. PATENT DOCUMENTS

| | | | | |
|---|---|---|---|---|
| 3,784,596 | A * | 1/1974 | Nagler | 524/238 |
| 5,003,022 | A | 3/1991 | Nguyen et al. | |
| 5,131,951 | A | 7/1992 | Yoshida et al. | 106/287.25 |
| 5,131,981 | A | 7/1992 | Hahn et al. | 162/162 |
| 5,296,284 | A | 3/1994 | Durham | 428/207 |
| 5,416,181 | A | 5/1995 | Nguyen et al. | 527/300 |
| 5,527,544 | A | 6/1996 | Nguyen et al. | 424/489 |
| 5,565,509 | A | 10/1996 | Nguyen et al. | 524/47 |
| 5,656,689 | A | 8/1997 | Fujiwara et al. | 524/822 |
| 5,667,885 | A | 9/1997 | Nguyen et al. | 428/327 |
| 5,800,870 | A * | 9/1998 | Luebke et al. | 427/369 |
| 6,387,500 | B1 | 5/2002 | Behl | 428/404 |
| 6,500,896 | B1 * | 12/2002 | Rajaraman | 524/552 |
| 2002/0066543 | A1 | 6/2002 | Lilly | 162/140 |
| 2003/0047118 | A1 * | 3/2003 | Perry et al. | 106/493 |
| 2003/0092833 | A1 * | 5/2003 | Frieling et al. | 524/589 |
| 2005/0250891 | A1 * | 11/2005 | Matuki | 524/430 |

FOREIGN PATENT DOCUMENTS

| | | | |
|---|---|---|---|
| CA | 2214210 | A * | 8/1997 |
| EP | 0 471 486 | | 2/1992 |
| EP | 0 575 625 | | 12/1993 |
| EP | 0 826 823 | | 3/1998 |
| GB | 526674 | | 9/1940 |
| JP | 59-089373 | A * | 5/1984 |
| JP | 60-215895 | A * | 10/1985 |
| JP | 03500059 | | 1/1991 |
| JP | 03503908 | | 8/1991 |
| JP | 04228698 | | 8/1992 |
| WO | 8909804 | | 10/1989 |
| WO | WO 01/90263 | A2 * | 11/2001 |
| WO | 02/46528 | | 6/2002 |

OTHER PUBLICATIONS

English language abstract from esp@cenet web cite printed Dec. 29, 2005 of EP 0826823.

English language abstract No. 1992-321129[39] of JP 04228698 [Aug. 1992].

* cited by examiner

*Primary Examiner* — Anthony Green

(74) *Attorney, Agent, or Firm* — Drinker Biddle & Reath

(57) ABSTRACT

The invention relates to a composition for controlling the bleed fastness of organic coloring pigments in paper coatings comprising a) 1 to 30% by weight, based on the total weight of the composition, of an organic coloring pigment, b) 1 to 20% by weight, based on the total weight of the composition, of one or more binders, c) 0 to 20% by weight, based on the total weight of the composition, of starch, d) 0 to 10% by weight, based on the total weight of the composition, of an anionic direct dye, e) 0 to 10% by weight, based on the total weight of the composition one or more auxiliaries and f) water to 100%, a method of application and use of the composition.

15 Claims, No Drawings

PAPER COATING COMPOSITIONS

This application is the National Stage of International Application No.

PCTEP2004/050443, filed on Apr.5, 2004, which claims benefit of GB 0308487.8, filed on Apr. 14, 2003.

This invention relates to a composition for controlling the bleed fastness of organic colouring pigments in paper coatings, a method and use of the composition in paper coating compositions and more particularly the use of specific binders in the composition, to control bleed fastness of organic pigments applied to paper.

WO 98/39514 describes a paper coating method in which a coating composition includes a binder wherein the binder comprises a stable aqueous dispersion of a water insoluble component and a water-soluble component. The water insoluble component comprises coalescable polymer particles which have a $T_g$ less than 55° C. and a majority of which have a particle size less than 1 micron; and the water soluble component comprises a water soluble polymer capable of inhibiting coalescence of said polymer particles, or a water soluble polymer and a component capable of inhibiting coalescence of said polymer particles; and wherein said water insoluble component comprises greater than 3% and less than 75% by weight of the binder solids and said water soluble component comprises greater than 25% and less than 97% of said binder solids. The purpose of this method is to provide improved crack at the fold properties for medium weight and heavy weight papers coated in a size press apparatus without adversely affecting other important properties or productivity of the papermaking process.

The aforesaid method, insofar as R is proposed for use with pigments is only concerned with inorganic pigments. It does not propose the use of organic pigments nor the problems of bleeding that arise with organic pigments that is to say colourants for surface colouration of paper. This problem is addressed by the present invention.

According to the invention there is provided a composition for controlling the bleed fastness of organic colouring pigments in paper coatings comprising a) 1 to 30% by weight, preferably from 2 to 25%, based on the total weight of the composition, of an organic colouring pigment, b) 1 to 20% by weight, preferably from 2 to 10%, based on the total weight of the composition, of one or more binders, c) 0 to 20% by weight, preferably from 0 to 10%, based on the total weight of the composition, of starch, d) 0 to 10% by weight, based on the total weight of the composition, of an anionic direct dye, e) 0 to 10% by weight, based on the total weight of the composition one or more auxiliaries and f) water to 100%.

The organic colouring pigments may encompass a wide variety of chemical constitutions, as exemplified in Colour Index International, Pigments and Solvent Dyes (The Society of Dyers and Colourists, 1997). Examples of such pigments, together with their C.I. constitution numbers are nitroso compounds (10000-10299), nitro compounds (10300-10999), monoazo (11000-19999) and disazo (20000-29999) pigments, stilbenes (40000-40799), diphenylmethanes (41000-41999), triarylmethanes (42000-44999), xanthenes (45000-45999), acridines (46000-46999), quinolines (47000-47999), methines (48000-48999), thiazoles (49000-49399), indamines (49400-49699), indophenols (49700-49999), azines (50000-50999), oxazines (51000-51999), thalzines (52000-52999), aminoketones (56000-56999), anthraquinones (58000-72999), indigoid derivatives (73000-73999) and phthalocyanines (74000-74999).

One preferred binder, component b) according to the invention, comprises a stable aqueous dispersion of a water insoluble component and a water soluble component, whereby the water insoluble component comprises coalescable polymer particles which have a $T_g$ less than 55° C. and at least 50% of which have a particle size less than 1 micron and the water soluble component comprises a water soluble polymer capable of inhibiting coalescence of said polymer particles, or a water soluble polymer and a component capable of inhibiting coalescence of said polymer particles, wherein said water insoluble component comprises greater than 3% and less than 75% by weight of the binder solids and said water soluble component comprises greater than 25% and less than 97% of said binder solids. Such binders and closer definitions thereof are disclosed, for example, in U.S. Pat. No. 5,416,181. Especially preferred binders are starch styrene/butadiene copolymers available, for example, from Penfold Products Company under the name Pensize®, the product Pensize® 730 being particularly suitable.

Alternatively, component b) of the invention may comprise a water insoluble synthetic polymer derived from one or more dienes and/or unsaturated monomers, such products being termed synthetic latex. Examples of diene monomers, suitable for the preparation of latex, may include 1,3-butadiene, isoprene, chloroprene, cydobutadiene and divinyl benzene, whilst suitable unsaturated monomers may include alkyl acrylates and methacrylates, hydroxylated alkyl methacrylates, ally vinyl ketones, substituted acrylamides, methacrylic acid, N-methylol acrylamide, 2-hydroxyethyl acrylate, crotonic acid, itaconic acid, fumaric acid, maleic acid, maleic anhydride, vinyl halides, vinylidene halides, vinyl esters, vinyl ethers, vinyl carbazole, N-vinyl pyrrolidone, vinyl pyridine, chlorostyrene, alkyl styrene, ethylene, propylene, isobutylene, vinyl triethoxy silane and triphenyl vinyl silane. Preferred monomers include methyl methacrylate, dimethylamino ethyl acrylate, dimethylamino propyl acrylamide, vinyl acetate, acrylonitrile, acrylic acid, acrylamide, maleic anhydride, monovinyl silicon compounds including vinyl trimethyl silane, ethyl vinyl ether, chlorostyrene, vinyl pyridine, butyl vinyl ether, 2-ethylhexyl acrylate, isoprene and chloroprene, with vinylidine chloride, butyl vinyl ether and, especially styrene, being preferred. Most preferred latex is that derived from styrene and butadiene.

When starch is present in the composition, starch materials, useful as the binder component c) of the composition of the invention include practically all thinned starches of plant origin including starches from corn, wheat, potatoes, tapioca, rice, sago and sorghum. Waxy and high amylase starches may also be suitable. The starches can be thinned by acid hydrolysis, oxidative hydrolysis or enzymatic degradation. Further derivatized starches also suitable include those such as starch ethers, starch esters, cross-linked starches, oxidized starches and chlorinated starches, for example, carboxymethy cellulose and hydroxyethyl methyl cellulose.

Should the composition additionally contain an anionic direct dye, this is selected from those dyes suitable for the dyeing of paper, as, for example, cited in The Colour Index International (The Society of Dyers and Colourists, 1971, pages 2005-2478). The majority of these dyes belong to the bis-, tris and polyazo classes of chemical compounds, in addition to monoazo, stilbene, oxazine, thiazole and phthalocyanine dyes. Such products are available from Ciba Specialty Chemicals, being marketed under the Pergasol® range, such as Pergasol® Red 2G (C.I. Direct Red 239) and Pergasol Turquoise GN (C.I. Direct Blue 86).

The addition of such anionic direct dyes may be advantageous in that less colouring pigment may be required to achieve the required colour density, which is of interest from an economic viewpoint.

Furthermore, the composition of the invention may contain further auxiliaries selected from fixing agents, additional binder and binder resins, insolubilzing and/or crosslinking agents, anionic, cationic and neutral polymers, wet-strength agents, antifoams and biocides. Suitable auxiliaries may, for example, include polyethyleneimines and derivatives thereof, inorganic salts such as sodium chloride, magnesium chloride and potassium chloride, alum, polydiallyl dimethyl ammonium chloride, polyamide amine resins, polyvinyl alcohol, polyvinyl pyrrolidone and homo and copolymers thereof, polyesters and polyethers, glyoxal derivatives, monoethanolamine, acrylic acid/alkyl acrylate copolymers and styrene/acrylate copolymers.

In one further aspect, the invention provides a method of controlling the bleed fastness of organic colouring pigments in paper coating compositions, by applying to the paper a composition as defined above.

Preferably, the composition is applied to the paper web after it has been dried to about 80-95% solids at the sizing press or by means of an on-line coater. Alternatively, the composition can be applied once the paper has been fully dried in an off-machine coating process, such as by spraying, curtain coating or by conventional coating processes.

Such application processes are described in "Pigment Coating and Surface Sizing of Papers" by E. Lehtinen, published by Tappi International, 2000.

Consequently, a still further aspect of the invention is the use of the composition, as disclosed above, for controlling the bleed fastness of organic colouring pigments in paper coating compositions and also paper, which has been treated with the composition.

In most cases the use of the composition, containing the binder as component b), considerably improves the bleed fastness compared to coatings where this binder is omitted and, furthermore, leads to coatings of considerably higher colour strengths.

The following examples further illustrate the invention, without intending to be restrictive in nature.

EXAMPLES

Size press baths were prepared, with each bath consisting of 100 grams total, of which 50 grams was a 10% solution of an oxidized farina starch.

After additions of starch, colouring pigment and binder ("Pensize®" 730 commercially available from Penford Corporation of Bellevue, Wash., USA), the total was made up to 100 grams with water.

Each bath was added, in turn, to a Werner Mathis size press, and a sample of white base paper passed through to produce a coloured sheet.

The base paper, consisted of:

| | |
|---|---|
| 70% | Bleached Hardwood Kraft |
| 30% | Bleached Softwood Kraft |
| Loading | 10% retained clay plus 1% retained chalk |
| Sizing | 0.5% Pseudo neutral size (Hercat 27JP4), adjusted to pH 6.0-6.5 with alum |

This base paper was prepared on the pilot paper machine at The University of Manchester Institute of Science and Technology.

Each size pressing was checked for wet pick up (which varied from product to product, but generally speaking was found to be in the region of 40%, giving approximately 2% Pensize 730 on weight of paper) and dried in an infrared dryer for the minimum time required to give complete drying.

In the following Tables, percentages of the components are calculated taking into account the wet pick up and, consequently represent the percentages actually present on the paper based on the paper weight.

Colorants, both pigments and direct dyes, are defined according to their Colour Index (C.I.) designations, as cited above.

TABLE 1

| Example No. | % Colourant | Composition | Bleed Fastness |
|---|---|---|---|
| 1 | 3.3% Pigment Yellow 1 | 2% Starch | 4 |
| 2 | 3.6% Pigment Yellow 1 | 2% Starch<br>2% Pensize 730 | 5 |
| 3 | 1.8% Pigment Yellow 13 | 2% Starch | 3-4 |
| 4 | 2.0% Pigment Yellow 13 | 2% Starch<br>2% Pensize 730 | 5 |
| 5 | 1.3% Pigment Yellow 83 | 2% Starch | 3-4 |
| 6 | 1.4% Pigment Yellow 83 | 2% Starch<br>2% Pensize 730 | 5 |
| 7 | 2.9% Pigment Red 2 | 2% Starch | 3-4 |
| 8 | 4.2% Pigment Red 2 | 2% Starch<br>2% Pensize 730 | 4-5 |
| 9 | 6.4% Pigment Red 5 | 2% Starch | 3 |
| 10 | 6.8% Pigment Red 5 | 2% Starch<br>2% Pensize 730 | 5 |
| 11 | 8.0% Pigment Red 81 | 2% Starch | 2 |
| 12 | 8.8% Pigment Red 81 | 2% Starch<br>2% Pensize 730 | 2-3 |
| 13 | 2.6% Pigment Violet 23 | 2% Starch | 3 |
| 14 | 2.8% Pigment Violet 23 | 2% Starch<br>2% Pensize 730 | 4-5 |
| 15 | 2.5% Pigment Violet 3 | 2% Starch | 2-3 |
| 16 | 2.7% Pigment Violet 3 | 2% Starch<br>2% Pensize 730 | 3 |
| 17 | 3.3% Pigment Blue 15 | 2% Starch | 4 |
| 18 | 3.6% Pigment Blue 15 | 2% Starch<br>2% Pensize 730 | 5 |
| 19 | 3.2% Pigment Green 7 | 2% Starch | 3-4 |
| 20 | 3.5% Pigment Green 7 | 2% Starch<br>2% Pensize 730 | 4-5 |
| 21 | 2.9% Pigment Green 8 | 2% Starch | 5 |
| 22 | 3.2% Pigment Green 8 | 2% Starch<br>2% Pensize 730 | 5 |
| 23 | 0.9% Pigment Black 7 | 2% Starch | 5 |
| 24 | 2.0% Pigment Black 7 | 2% Starch<br>2% Pensize 730 | 5 |

The bleed flatness indicated in the above table was assessed by placing samples of colored paper between white blotters soaked in de-ionized water. These blotters were placed between glass plates and the whole wrapped in cling film. A 1-kilogram weight was placed on the top of the glass plates, and the whole left for 24 hours.

After 24 hours, the blotting paper was air-dried and when dry, assessed for bleed using the standard grey scale, ref ISO 105-A03 1993.

This scale is a range of grey-coated shades increasing in intensity. Each sample is placed adjacent to a white-coated sample, such that increases in contrast are obtained. The scale itself goes from 5, where no contrast is seen (in effect 2 white coated samples) down to 1 where a considerable contrast is observed. The bleed from the coloured sample is compared to this scale, and the contrast in the grey/white, which most closely concurs with the contrast in the white blotter/bleed, is taken as the bleed fastness rating for a piece of paper. The grey scale is prepared with "half units" i.e. 1-2, 2-3, 3-4, 4-5.

Quite clearly, the inclusion of Pensize 730 into the dye bath formulation has had an improvement on all samples where bleed was seen where the binder was omitted.

Further examples of the claimed coating compositions applied to, 137 weight file folder stock are shown in the following Table 2. The coating colours are prepared in an analogous manner to those of the previous Table 1, but in some cases, without the oxidized farina starch or replacement thereof by other conventional commercial binders.

In these cases, all grey scale assessments of bleed fastness were made on the top and bottom sides of the paper and this is denoted by subdivisions, for example, 3-4/4, indicating a value of 3-4 on the top side and 4 on the bottom side.

TABLE 2

| Example No. | % Colourant | Composition | Bleed Fastness |
|---|---|---|---|
| 25 | 2.0% Pigment Blue 15.3 | 7% Starch | 2-3/3 |
| 26 | 2.0& Pigment Blue 15.3 | 5% Pensize 730 | 5/5 |
| 27 | 3.4% Pigment Blue 15.3 + 1.1% Pigment Blue 15 | 12% Pensize 730 | 5/5 |
| 28 | 2.25% Pigment Blue 15.3 + 1.5% Pigment Blue 15 | 15% Pensize 730 | 5/5 |

TABLE 2-continued

| Example No. | % Colourant | Composition | Bleed Fastness |
|---|---|---|---|
| 29 | 1.2% Pigment Red 5 + 1.9% Direct Red 239 | 1% Monoethanolamine + 7.5% PAA[a)] | 3-4/4 |
| 30 | 1.2% Pigment Red 5 + 1.9% Direct Red 239 | 1% Monoethanolamine + 7.5% PAA[a)] + 15% Pensize 730 | 4-5/4-5 |
| 31 | 4% Pigment Red 5 | 7% Starch | 2-3/3 |
| 32 | 4% Pigment Red 5 | 5% Pensize 730 | 5/5 |
| 33 | 4% Pigment Red 5 | 15% Pensize 730 | 5/5 |
| 34 | 3% Pigment Blue 15 + 3% Direct Blue 86 | 15% Pensize 730 + Sodium Carbonate (to pH 9.5) | 3/3 |
| 35 | 3% Pigment Blue 15 + 3% Direct Blue 86 | 1% Monoethanolamine + 10% PAA[a)] | 4-5/4-5 |
| 36 | 3% Pigment Blue 15 + 3% Direct Blue 86 | 1% Monoethanolamine + 7.5% PAA[a)] + 12% Pensize 730 | 4/4 |
| 37 | 2.5% Pigment Yellow 14 | 5% Pensize 730 | 4-5/4-5 |

Footnote:
[a)]PAA is a polyamide amine resin binder available from Clariant under the designation Cartaretin ® F-4

The following Table 3 summarized the results of further experiments demonstrating the effect of both latex- and modified starch-based (Pensize) formulations of the invention in enhancing both bleed fastness and colour strength of colouring pigment coatings.

The designation "RD %" indicates the relative colour strengths of the coatings at 0.2 standard depth dyeing

TABLE 3

| Example No. | % Colourant | Composition | Bleed Fastness | RD % |
|---|---|---|---|---|
| 38 | 4.01% Pigment Blue 15 | 2.3% Starch | 2-3/3 | 86% |
| 39 | 4.01% Pigment Blue 15 | 2.2% Starch 4.5% Dow DL-950 L ®[a)] | 4/5 | 137% |
| 40 | 4.01% Pigment Blue 15 | 2.2% Starch 4.5% Pensize 730 | 4/5 | 100% |
| 41 | 4.01% Pigment Yellow 1 | 2.2% Starch 4.5% Dow DL-950 L ®[a)] | 5 | 138% |
| 42 | 4.01% Pigment Yellow 1 | 2.2% Starch 4.5% Pensize 730 | 5 | 100% |
| 43 | 2.3% Pigment Yellow 13 | 2.2% Starch 4.5% Dow DL-950 L ®[a)] | 5 | 112% |
| 44 | 2.3% Pigment Yellow 13 | 2.2% Starch 4.5% Pensize 730 | 5 | 100% |
| 45 | 3.6% Pigment Red 2 | 2.2% Starch 4.5% Dow DL-950 L ®[a)] | 4/5 | 123% |
| 46 | 3.6% Pigment Red 2 | 2.2% Starch 4.5% Pensize 730 | 5 | 100% |
| 47 | 8.6% Pigment Red 5 | 2.2% Starch 4.5% Dow DL-950 L ®[a)] | 4/5 | 99% |
| 48 | 8.6% Pigment Red 5 | 2.2% Starch 4.5% Pensize 730 | 4/5 | 100% |
| 49 | 10.0% Pigment Red 81 | 2.2% Starch 4.5% Dow DL-950 L ®[a)] | 3/4 | 99% |
| 50 | 10.0% Pigment Red 81 | 2.2% Starch 4.5% Pensize 730 | 2/3 | 100 |
| 51 | 3.3% Pigment Violet 23 | 2.2% Starch 4.5% Dow DL-950 L ®[a)] | 4/5 | 122% |
| 52 | 3.3% Pigment Violet 23 | 2.2% Starch 4.5% Pensize 730 | 4 | 100% |
| 53 | 3.1% Pigment Violet 3 | 2.2% Starch 4.5% Dow DL-950 L ®[a)] | 4 | 108% |
| 54 | 3.1% Pigment Violet 3 | 2.2% Starch 4.5% Pensize 730 | 4 | 100% |
| 55 | 5.5% Pigment Violet 19 | 2.2% Starch 4.5% Dow DL-950 L ®[a)] | 5 | 113% |
| 56 | 5.5% Pigment Violet 19 | 2.2% Starch 4.5% Pensize 730 | 5 | 100% |
| 57 | 2.1% Pigment Blue 15 + 2.1% Pigment Violet 3 | 2.2% Starch 4.5% Dow DL-950 L ®[a)] | 4 | 114% |

TABLE 3-continued

| Example No. | % Colourant | Composition | Bleed Fastness | RD % |
|---|---|---|---|---|
| 58 | 2.1% Pigment Blue 15 + 2.1% Pigment Violet 3 | 2.2% Starch<br>4.5% Pensize 730 | 4 | 100% |
| 59 | 4.0% Pigment Green 7 | 2.2% Starch<br>4.5% Dow DL-950 L ®[a)] | 4/5 | 106% |
| 60 | 4.0% Pigment Green 7 | 2.2% Starch<br>4.5% Pensize 730 | 4 | 100% |
| 61 | 0.9% Pigment Black 7 | 2.2% Starch<br>4.5% Dow DL-950 L ®[a)] | 5 | 228 |
| 62 | 0.9% Pigment Black 7 | 2.2% Starch<br>4.5% Pensize 730 | 5 | 100% |

Footnote:
[a)]Dow DL-950 L ® is a latex binder available from Dow Chemicals Incorporated.

Similar coatings exhibiting excellent bleed fastness and high colour densities may also be obtained by employing the compositions summarized in the following Table 4.

TABLE 4

| Example No. | % Colourant | Composition |
|---|---|---|
| 63 | 10% Pigment Red 81 | 2.2% Starch<br>4.5% Dow DL-950 L ®<br>0.5% Tinofix ® ECO-N[a)] |
| 64 | 10% Pigment Red 81 | 2.2% Starch<br>4.5% Dow DL-950 L ®<br>0.5% Tinofix ® AP[a)] |
| 65 | 10% Pigment Red 81 | 2.2% Starch<br>4.5% Dow DL-950 L ®<br>0.5% Tinofix ® WSP[a)] |
| 66 | 10% Pigment Red 81 | 2.2% Starch<br>4.5% Dow DL-950 L ®<br>2.0% Pensize 730<br>0.5% Tinofix ® ECO-N[a)] |
| 67 | 10% Pigment Red 81 | 2.2% Starch<br>4.5% Dow DL-950 L ®<br>0.5% Tinofix ® ECO-N[a)]<br>1.0% Polvinyl alcohol |
| 68 | 10% Pigment Red 81 | 2.2% Starch<br>4.5% Dow DL-950 L ®<br>1% Polyvinyl pyrrolidone |
| 69 | 10% Pigment Red 81 | 2.2% Starch<br>4.5% Dow DL-950 L ®<br>1.0% Polyvinyl alcohol |
| 70 | 10% Pigment Red 81 | 2.2% Starch<br>4.5% Dow DL-950 L ®<br>1.0% Polyvinyl alcohol<br>0.5% Glyoxal derivative[b)] |
| 71 | 10% Pigment Red 81 | 2.2% Starch<br>4.5% Dow DL-950 L ®<br>1.0% Sequarez ® 755[c)] |
| 72 | 3.1% Pigment Violet 3 | 2.2% Starch<br>4.5% Pensize 730<br>0.3% Percol ® 181[d)] |
| 73 | 3.1% Pigment Violet 3 | 2.2% Starch<br>4.5% Pensize 730<br>0.3% Percol ® 156[e)] |
| 74 | 3.1% Pigment Violet 3 | 2.2% Starch<br>4.5% Pensize 730<br>1.0% Glascol ® LE 15[f)]<br>0.6% Monoethanolamine |
| 75 | 3.1% Pigment Violet 3 | 2.2% Starch<br>4.5% Pensize 730<br>1.0% Glascol ® LS 26[f)] |

TABLE 4-continued

| Example No. | % Colourant | Composition |
|---|---|---|
| 76 | 3.1% Pigment Violet 3 | 2.2% Starch<br>4.5% Pensize 730<br>1.0% Glascol ® LS 26[f)] |

Footnotes:
[a)]Tinofix ® ECO-N, AP and WSP are fixing agents available from Ciba Specialty Chemicals
[b)]The glyoxal derivative is present as insolubilizer and is commercially available
[c)]Sequarez ® 755 is a wet strength agent available from Omnova Chemicals
[d)]Percol ® 181 is a cationic polymer present as retention agent and is available from Ciba Specialty Chemicals
[e)]Percol ® 156 is an anionic polymer present as retention agent and is available from Ciba Specialty Chemicals
[f)]Glascol ® LE, LS 26 and LE 520 are binder resin dispersing agents available from Ciba Specialty Chemicals.

The invention claimed is:

1. A composition for controlling the bleed fastness of organic colouring pigments in paper coatings comprising;

a) 1 to 30% by weight, based on the total weight of the composition, of an organic colouring pigment, b) 1 to 20% by weight, based on the total weight of the composition, of one or more binders, c) 0 to 20% by weight, based on the total weight of the composition, of starch, d) 1.9 to 10% by weight, based on the total weight of the composition, of an anionic direct dye, e) 0 to 10% by weight, based on the total weight of the composition one or more auxiliaries and f) water to 100%, wherein the organic colouring pigment is selected from the group consisting of: a nitroso compound, a nitro compound, a monoazo pigment, a disazo pigment, a stilbene, a diphenylmethane, a triarylmethane, a xanthene, an acridine, a quinoline, a methine, a thiazole, an indamine, an indophenol, an azine, an oxazine, a thaizine, an aminoketone, an anthraquinone, and an indigoid, the pigments being described in the Colour Index International (The Society of Dyers and Colourists, 1997) and where component b) comprises a stable aqueous dispersion of a water insoluble component and a water soluble component, whereby the water insoluble component comprises coalescable polymer particles which have a $T_g$ less than 55° C. and at least 50% of which have a particle size less than 1 micron and the water soluble component comprises a water soluble polymer capable of inhibiting coalescence of said polymer particles, or a water soluble polymer and a component capable of inhibiting coalescence of said polymer particles, wherein said water insoluble component comprises greater than 3% and less than 75% by weight of binder solids and said water soluble component comprises greater than 25% and less than 97% of binder solids.

2. The composition according to claim 1, wherein the anionic direct dye is selected from the group consisting of: a bis-azo, a tris-azo, a polyazo, a monoazo, a stilbene, an oxazine, a thiazole, and a phthalocyanine dye.

3. The composition according to claim 1, comprising the auxiliary, wherein the auxiliary is selected from the group consisting of: a fixing agent, an additional binder resin, an insolubilizing agent, a crosslinking agent, an anionic polymer, a cationic polymer, a neutral polymer, a wet-strength agent, an antifoam, and a biocide.

4. A method of controlling the bleed fastness of organic colouring pigments in paper coating compositions, by applying to the paper a composition as defined in claim 1.

5. Paper, which has been treated with the composition as defined in claim 1.

6. A composition for controlling the bleed fastness of organic colouring pigments in paper coatings comprising;

a) 1 to 30% by weight, based on the total weight of the composition, of an organic colouring pigment, b) 1 to 20% by weight, based on the total weight of the composition, of one or more binders, c) 0 to 20% by weight, based on the total weight of the composition, of starch, d) 0 to 10% by weight, based on the total weight of the composition one or more auxiliaries e) 1.9 to 10% by weight, based on the total weight of the composition, of an anionic direct dye, and f) water to 100%, wherein the organic colouring pigment is selected from the group consisting of: a nitroso compound, a nitro compound, a monoazo pigment, a disazo pigment, a stilbene, a diphenylmethane, a triarylmethane, a xanthene, an acridine, a quinoline, a methine, a thiazole, an indamine, an indophenol, an azine, an oxazine, a thaizine, an aminoketone, an anthraquinone, and an indigoid, the pigments being described in the Colour Index International (The Society of Dyers and Colourists, 1997) and where the binders comprise a water insoluble synthetic latex polymer derived from one or more dienes and/or unsaturated monomers.

7. The composition according to claim 6, wherein the anionic direct dye is selected from the group consisting of: a bis-azo, a tris-azo, a polyazo, a monoazo, a stilbene, an oxazine, a thiazole, and a phthalocyanine dye.

8. The composition according to claim 6, comprising the auxiliary, wherein the auxiliary selected from the group consisting of: a fixing agent, an additional binder resin, an insolubilizing agent, a crosslinking agent, an anionic polymer, a cationic polymer, a neutral polymer, a wet-strength agent, an antifoam, and a biocide.

9. A method of controlling the bleed fastness of organic colouring pigments in paper coating compositions, by applying to the paper a composition as defined in claim 6.

10. Paper, which has been treated with the composition as defined in claim 6.

11. A composition for controlling the bleed fastness of organic colouring pigments in paper coatings comprising;

a) 1 to 30% by weight, based on the total weight of the composition, of an organic colouring pigment, b) 1 to 20% by weight, based on the total weight of the composition, of one or more binders, c) 0 to 20% by weight, based on the total weight of the composition, of starch, d) 0 to 10% by weight, based on the total weight of the composition one or more auxiliaries, e) 1.9 to 10% by weight, based on the total weight of the composition, of an anionic direct dye, and f) water to 100%, wherein the organic colouring pigment is selected from the group consisting of: a nitroso compound, a nitro compound, a monoazo pigment, a disazo pigment, a stilbene, a diphenylmethane, a triarylmethane, a xanthene, an acridine, a quinoline, a methine, a thiazole, an indamine, an indophenol, an azine, an oxazine, a thaizine, an aminoketone, an anthraquinone, and an indigoid, the pigments being described in the Colour Index International (The Society of Dyers and Colourists, 1997) and where component b) comprises a stable aqueous dispersion of a water insoluble component and a water soluble component, whereby the water insoluble component comprises coalescable polymer particles which have a $T_g$ less than 55° C. and at least 50% of which have a particle size less than 1 micron and the water soluble component comprises a water soluble polymer capable of inhibiting coalescence of said polymer particles, or a water soluble polymer and a component capable of inhibiting coalescence of said polymer particles, wherein said water insoluble component comprises greater than 3% and less than 75% by weight of binder solids and said water soluble component comprises greater than 25% and less than 97% of binder solids.

12. The composition according to claim 11, wherein the anionic direct dye is selected from the group consisting of: a bis-azo, a tris-azo, a polyazo, a monoazo, a stilbene, an oxazine, a thiazole, and a phthalocyanine dye.

13. The composition according to claim 11, comprising the auxiliary, wherein the auxiliary is selected from the group consisting of: a fixing agent, an additional binder resin, an insolubilizing agent, a crosslinking agent, an anionic polymer, a cationic polymer, a neutral polymer, a wet-strength agent, an antifoam, and a biocide.

14. A method of controlling the bleed fastness of organic colouring pigments in paper coating compositions, by applying to the paper a composition as defined in claim 11.

15. Paper, which has been treated with the composition as defined in claim 11.

* * * * *